US005099292A

United States Patent [19]

Hirose

[11] Patent Number: 5,099,292

[45] Date of Patent: Mar. 24, 1992

[54] FINISHER FOR AN IMAGE FORMING APPARATUS

[75] Inventor: Akira Hirose, Tokyo, Japan

[73] Assignee: Ricoh Company, Ltd., Tokyo, Japan

[21] Appl. No.: 691,723

[22] Filed: Apr. 26, 1991

[30] Foreign Application Priority Data

| | | | |
|---|---|---|---|
| Apr. 27, 1990 | [JP] | Japan | 2-110287 |
| Apr. 27, 1990 | [JP] | Japan | 2-110288 |
| Apr. 27, 1990 | [JP] | Japan | 2-110290 |
| Feb. 25, 1991 | [JP] | Japan | 3-50266 |

[51] Int. Cl.[5] ..... G03G 21/00

[52] U.S. Cl. ..... 355/324; 355/308; 271/292; 271/221; 270/37; 270/53

[58] Field of Search ..... 355/324, 322, 317, 311, 355/308, 309, 321; 271/292-294, 221; 270/37, 53, 58

[56] References Cited

U.S. PATENT DOCUMENTS

| | | | |
|---|---|---|---|
| 4,681,310 | 7/1987 | Cooper | 271/293 X |
| 4,687,191 | 8/1987 | Stemmle | 271/293 X |
| 4,925,171 | 5/1990 | Kramer et al. | 271/293 X |
| 4,928,941 | 5/1990 | Uto et al. | 270/53 |
| 4,971,302 | 11/1990 | Morii et al. | 270/53 |

FOREIGN PATENT DOCUMENTS

| | | | |
|---|---|---|---|
| 0134473 | 6/1988 | Japan | 271/293 |
| 2066217 | 7/1981 | United Kingdom | 271/294 |

*Primary Examiner*—Joan H. Pendegrass
*Assistant Examiner*—Matthew S. Smith
*Attorney, Agent, or Firm*—Oblon, Spivak, McClelland, Maier & Neustadt

[57] ABSTRACT

A finisher for use with a copier, laser printer or similar image forming apparatus and having a function of sorting or stacking sheets sequentially driven out of the apparatus and a function of stapling each stack of such sheets. A plurality of bins are sequentially moved to a position where the bins face the sheet outlet of the apparatus one at a time. A particular pair of the bins define a sheet inlet for receiving the sheets coming out of the sheet outlet one at a time. The sheets are distributed to the bins via the inlet to be stacked on the bins. A sheet stack is pulled out of each bin by a sheet stack moving device, bound at a staple position by a stapler, and then returned to the bin.

9 Claims, 13 Drawing Sheets

FINISHER FOR AN IMAGE FORMING APPARATUS

BACKGROUND OF THE INVENTION

The present invention relates to a finisher for use with a copier, laser printer or similar image forming apparatus and, more particularly, to a finisher having a function of sorting or stacking sheets which are sequentialy driven out of the apparatus and a function of binding stacks of such sheets one by another.

A finisher such as a sorter is extensively used with a copier or similar image forming apparatus for stacking recorded sheets on trays or bins in a sort mode or a stack mode. For example, a finisher disclosed in Japanese Patent Publication No. 44662/1988, for example, has a plurality of trays which are sequentially movable tgo a sheet discharge position for receiving recorded sheets from an image forming apparatus. An advanced finisher has even a function of stapling stacks of sheet distributed to the individual bins one by one. This kind of finisher, i.e., sorter/stapler may have a stapler which is movable to staple positions each being associated with respective one trays so as to sequentialy staple sheet stacks loaded on the trays, as taught in Japanese Patent Publication No. 302/1989 by way of example. Generally, the sorter/stapler is an attempt to add a stapling function to a sorter as an extra function. Therefore, some problems have been left unsolved in building a stapler in the copnventional sorter, as follows.

Sheets stacked on each tray by a sorter are often curled or otherwise deformed. Then, it is likely that not all of such deformed sheets are pulled out from the tray to the staple position, i.e., some sheets remain on the tray without being stapled. Moreover, the sheets are apt to bend along the curl while being moved toward the staple position. Generally, a sorter without a stapling function stacks sheets on each tray such that they gather at the center of the tray. Hence, a sorter needs an independent jogger for repositioning the sheets stacked at the center of the tray at a reference position which is close to a staple position located at one side of the tray. Furthermore, a conventional mechanism for moving a stack of sheets from the tray to the staple position is extremely complicated in construction.

SUMMARY OF THE INVENTION

It is therefore an object of the present invention to provide a finisher for an image forming apparatus which eliminates the drawbacks particular to the conventional finisher having sorting and stapling functions as discussed above.

It is another object of the present invention to provide a generally improved finisher for an image forming apparatus.

In accordance with the present invention, a finisher for use with an image forming apparatus for distributing a plurality of recorded sheets sequentially coming out of the apparatus through an outlet to a plurality of bins to stack the recorded sheets on the bins comprises a bin moving device for sequentially moving the plurality of bins to a predetermined position where the bins face the outlet, a bin inlet defined between, among the plurality of bins, an upper bin and a lower bin having been moved to the predetermined position for receiving the recorded sheets one at a time, a stapler for stapling the recorded sheets stacked on each of the plurality of bins at a staple position, and a sheet stack moving device for pulling out a stack of the recorded sheets from each of the plurality of bins to the staple position, causing the stapler to staple the stack, and then returning the stack to the bin.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

To better understand the present invention, a brief reference will be made to a prior art finisher for an image recording apparatus which is disclosed in Japanese Patent Publication No. 44662/1988.

Figure 15:
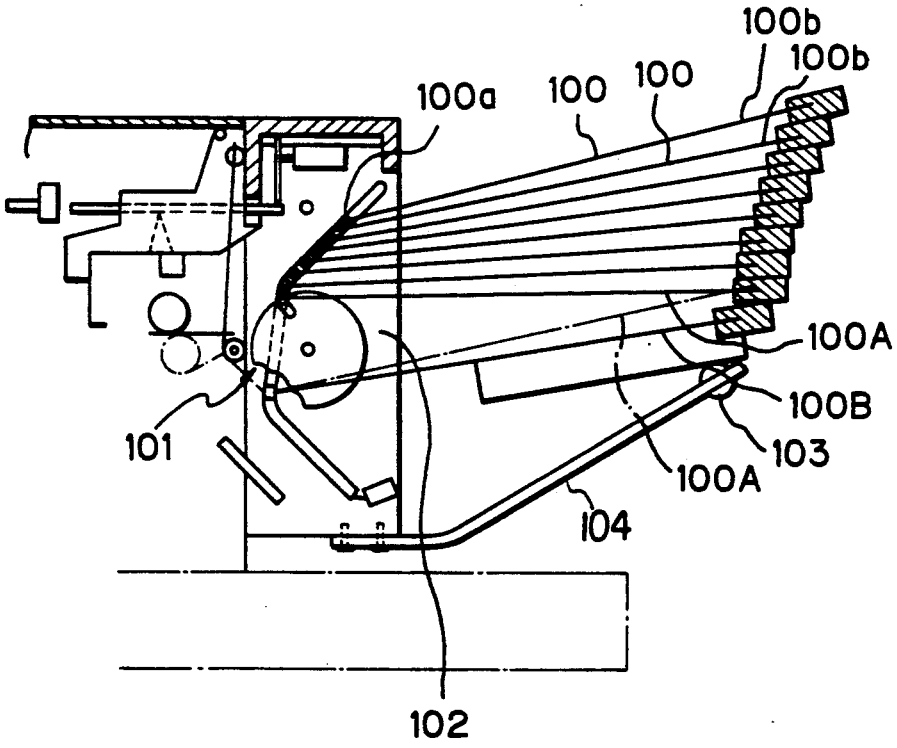
Fig. 15 PRIOR ART
FIG. 15 shows a conventional finisher.

As shown in FIG. 15, the prior art finisher has a plurality of trays 100 and a shifting device 101 for sequentially shifting, or turning over, the trays 100 one at a time. Every time a tray 100 is shifted, a sheet inlet 102 is defined between the tray 100 and the next tray 100 to face an outlet through which a sheet S is driven out of an image recording apparatus. Sheets S seuentially driven out of the apparatus are distributed to the trays 100 via the sheet inlet 102. The inner end **100*a* of each tray 100 which is adjacent to the apparatus is moved up and down by the shifting device 101. The outer ends 100*b* of the trays 100 are stacked one upon another. The lowermost tray 100 rests on a friction-resistive roller 103 which is mounted on a frame 104. When the trays 100 are sequentially shifted, they rotate about their outer ends 100*b* which are stacked one upon another. Assume that the second tray 100A from the bottom is raised by the shifting device 101, as indicated by dash-and-dot line in the figure. Then, the angular position of the tray 100A is didfferent from that of the first or bottom tray 100B. None of the trays 100** assumes the same angular position with the others at any point of movement. Therefore, when the finisher is provided with a stapler for stapling a stack of sheets, the stapler has to be rotated or otherwise moved little by little with each of the trays by an extremely complicated mechanism.

Figure 1:
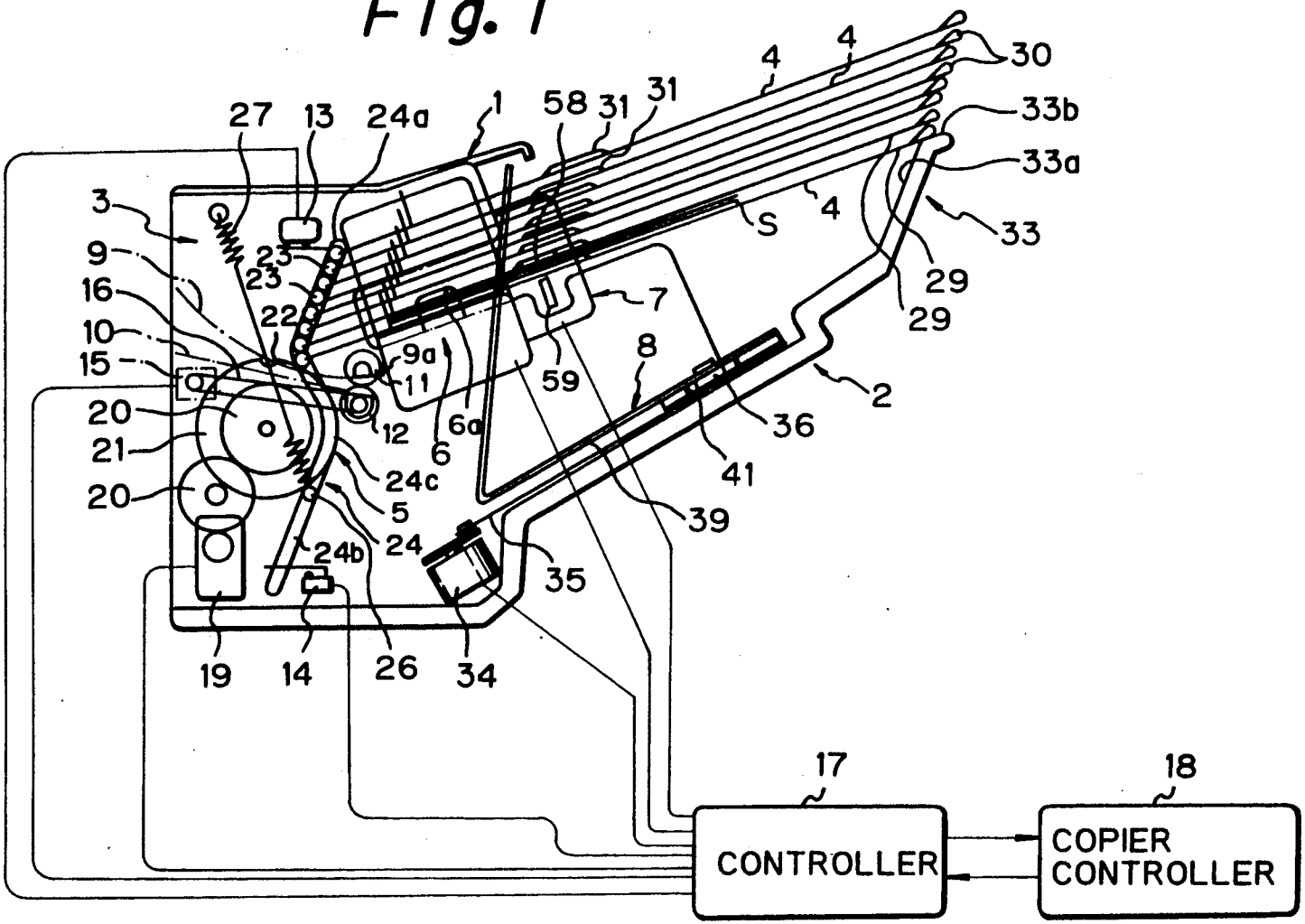
FIG. 1 is a side elevation showing a finisher embodying the present invention.

Referring to FIG. 1, a finisher embodying the present invention is shown and generally designated by the reference numeral 1. As shown, the finisher 1 has a bottom frame 2 and side frames 3 which in combination constitute a casing. A plurality of bins 4 are accommodated in the casing and stacked one upon another in such a manner as to be movable up and down. The inner ends of the bins 4 are moved up and down by a bin moving device 5. A stapler 6 having staples 6a and a sheet stack moving device 7 are mounted on the side frames 3. After the sheet stack moving device 7 has pulled out a stack of sheets S from a particular bin 4 toward the stapler 6, the stapler 6 staples it by a staple 6a. A jogger 8 is mounted on the lower frame 2. Every time a sheet S is driven out onto any one of the bins 4, the jogger 8 causes it to abut against a reference surface of the bin 4 adjacent to the stapler 6 and thereby position it accurately. An upper guide plate 9 and a lower guide plate 10 define a sheet transport path therebetween. An upper roller 11 and a lower roller 12 are rotatably mounted on the upper and lower guide plates 9 and 10, respectively, and form a roller pair in combination. A brush for dissipating electrostatic charge is disposed downstream of the upper roller 11. There are also shown in the figure an upper limit switch 13, a lower limit switch 14, a motor 15 for driving the lower roller 12, a belt 16 for transmitting the rotation of the motor 15 to the lower roller 12, and a controller 17 connected to the limit switches 13 and 14 and motor 15 for controlling them. The controller 17 is controlled by a controller 18 which is incorporated in a copier or similar image forming apparatus.

Figure 2:
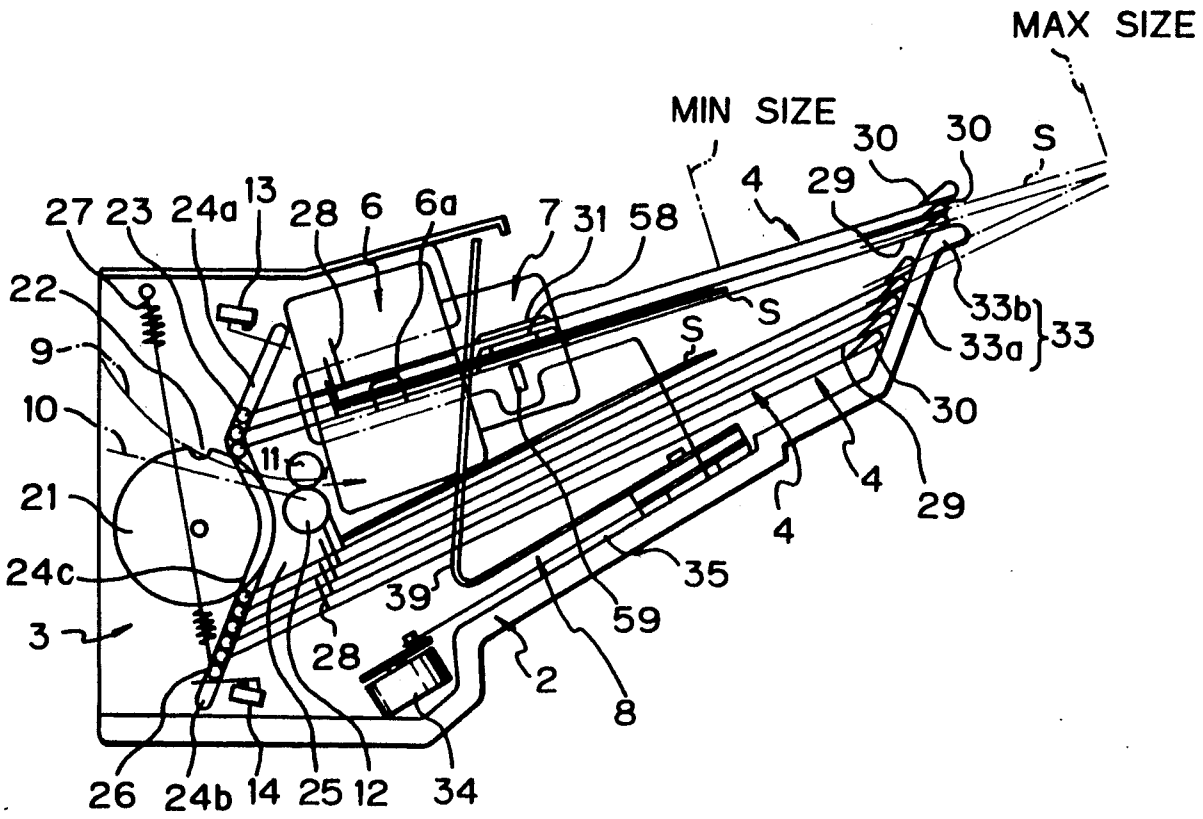
FIG. 2 shows the embodiment in a particular operating stage.
Figure 6:
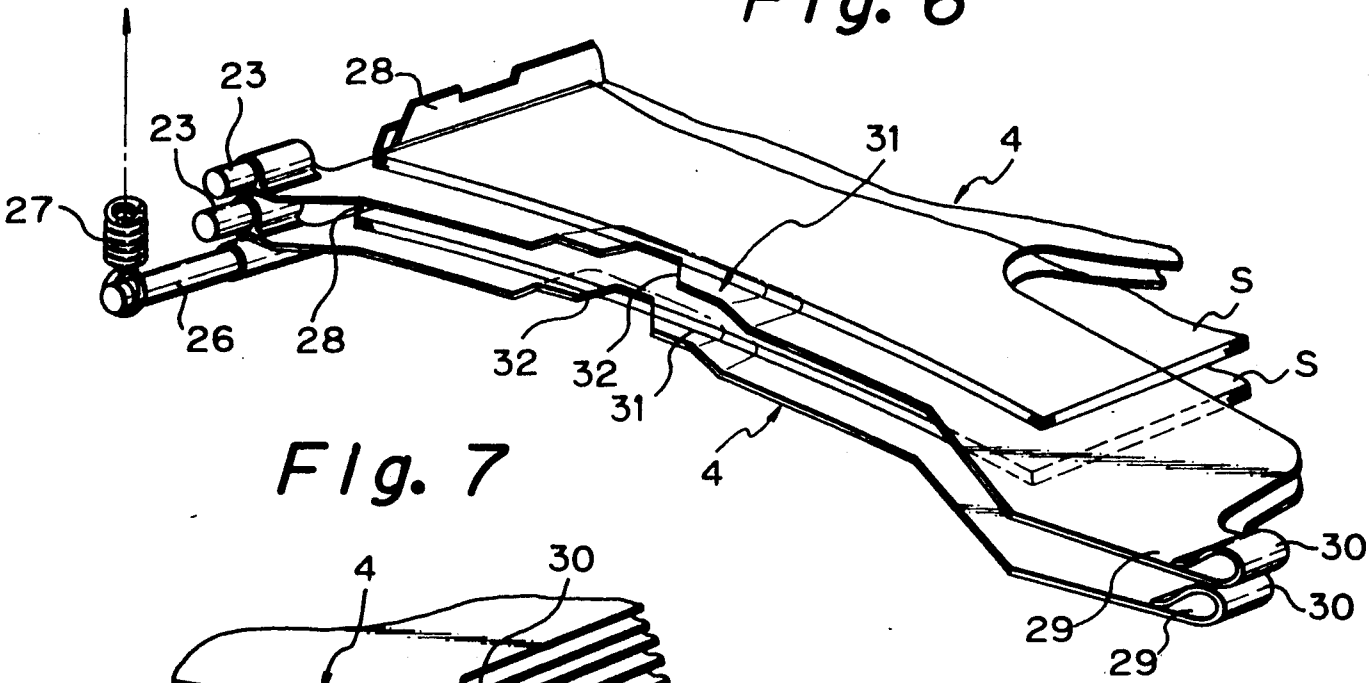
FIG. 6 is a perspective view of bins included in the embodiment.

As shown in FIGS. 1 and 2, the bin moving device 5 includes a Geneva wheel 21 while is driven reversibly by the motor 19 via a gear train 20. The Geneva wheel 21 has a single recess 22 on the outer periphery thereof, as illustrated. As shown in FIG. 6, pins 23 protrude from opposite sides of the inner end of each bin 4. Such pins 23 of the individual bins 4 are engageable with the recess 22 of the Geneva wheel 21 one at a time. The side frames 3 each is formed with a guide slot or channel 24. The pins 23 extending out from each bin 4 are received in the guide slots 24 of the side frames 3 and extend out to the outside of the frames 3. The guide slots 24 each has an upper and a lower linear portion 24a and 24b which are parallel to each other, and a curved portion 24c connecting the linear portions 24a and 24b to each other. Since the bent portion 24c overlaps the Geneva wheel 21, as shown in the figure, the pin 23 received in the guide slot 24 cannot move beyond the position where it abuts against the wheel 21. Specifically, when one pin 23 is received in the recess of the Geneva wheel 21 and moved into the lower linear portion 24b by the rotation of the wheel 21, as shown in FIG. 2, the next pin 23 is held in a halt in abutment against the periphery of the wheel 21. In this configuration, when the on pin 23, i.e., one bin 4 is moved downward from the upper linear portion 24a to the lower portion 24b by one rotation of the Geneva wheel 21, a space 25 is defined between the inner end of the lowermost bin 4 received in the upper linear portion 24a and the inner end of the uppermost bin 4 received in the lower linear portion 24b. A shaft 26 is disposed beneath the lowermost bin 4 and constantly biased upwardly by a coil spring 27 to in turn urge the pins 23 received in the lower linear poriton 24 upward. As a result, the uppermost pin 23 in the lower linear portion 24b is pressed against the periphery of the Geneva wheel 21 at all times. Hence, when the Geneva wheel 21 is reversed, the pin 23 positioned in the lower linear poriton 24b and pressing itself against the wheel 21 enters the recess 22 and then raised by the wheel 21 to the upper straight portion 24a.

Figure 7:
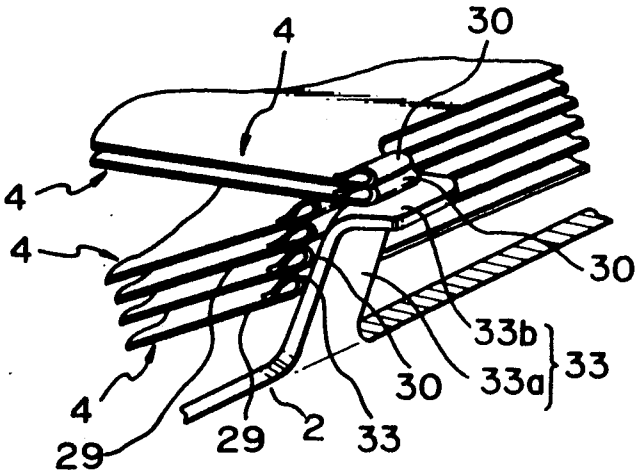
FIG. 7 is a fragmentary perspective view showing the leading edges of the bins and the leading edge of a frame.

As shown in FIG. 6, each bin 4 has an upright rear fence 28 extending from the inner or trailing end, extensions 29 extending out from both sides of the outer or leading end, spacers 30 formed by bending the extensions 29 upward, and an upwardly extending projection 31 and a notch 32 which are positioned at one side edge of the bin 4 which faces the sheet stack moving device 7. The projection 31 is formed by crimping the above-mentioned edge of the bin 4. The bin 4 is capable of accommodating a stack of sheets corresponding in thickness to the spacer 30. As shown in FIG. 7, the extensions 29 of the bins 4 are held by guide pieces 33 which extend upward from the outer upper edge of the lower frame 2. The guide pieces 33 each has an inclined leg 33a and a flat top 33b contiguous with the leg 33a. The distance between the upper linear portion 24a of the guide slot 24 and the top 33b of the guide piece 33 and the overall length of each bin 4 are selected such that the bin 4 with the extension 29 resting on the top 33b is the lowermost one of the group of bins 4 received in the linear portion 24a. As shown in FIG. 2, the lower linear portion 24b and the inclined leg 33a extend parallel to each other such that the extension 29 of the uppermost bin 4 existing in the lower linear portion 24b rests on the leg 33a dropping from the top 33b. The space 25 sequentially broadens toward the inner ends of the bins 4. In this configuration, the lowermost one of the upper group of bins 4 and the uppermost one of the lower group of bins 4 each is supported at opposite ends thereof in a particular position which does not change. Hence, every time the next bin 4 is moved to the bottom of the upper bin group or to the top of the lower bin group, it is brought to the above-mentioned particular position. It follows that the stapler 6 and sheet stack moving device 7 can be fixed in place in such a manner as to staple sheets S stacked on, for example, the lowermost bin 4 of the upper bin group at all times.

Figure 3:
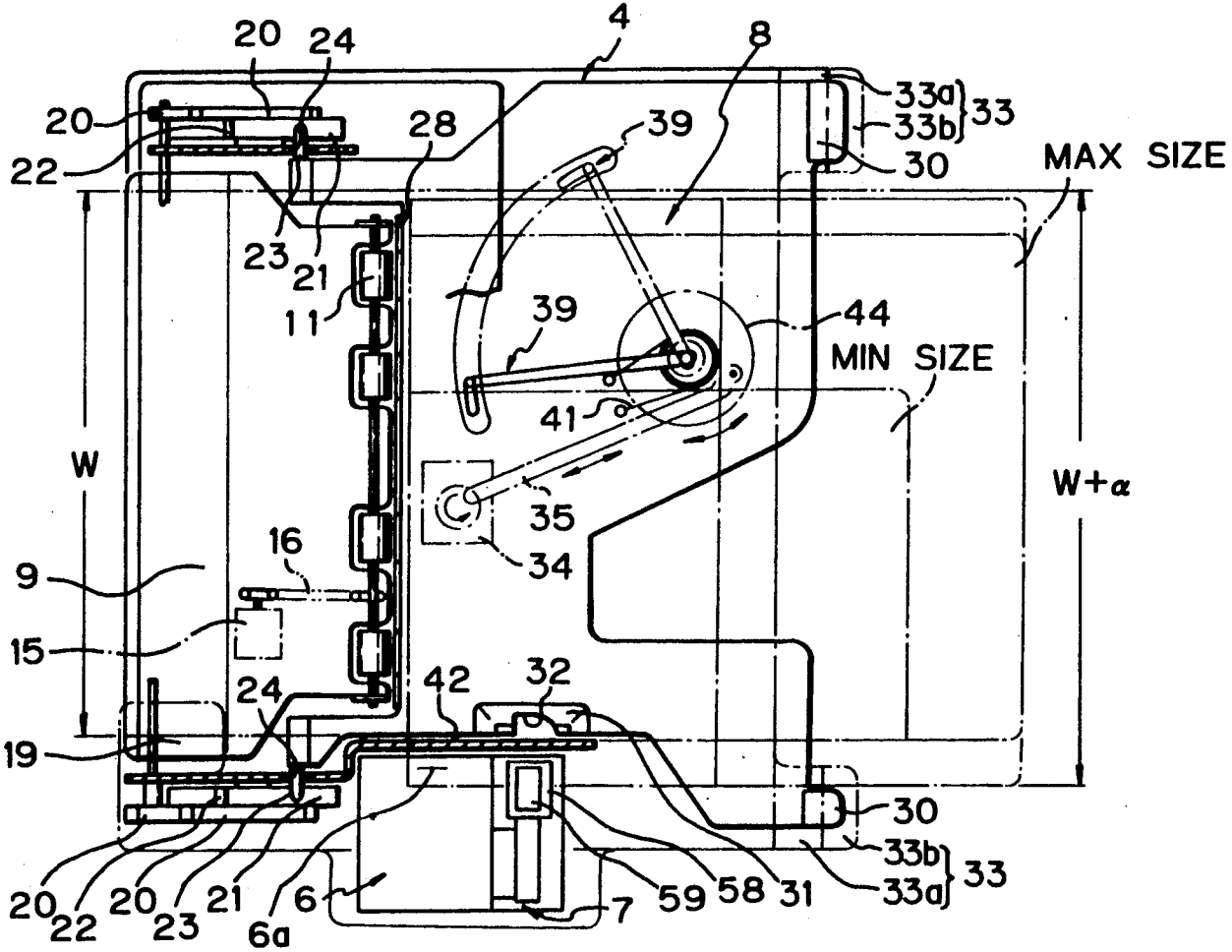
FIG. 3 is a top view of the embodiment.
Figure 4:
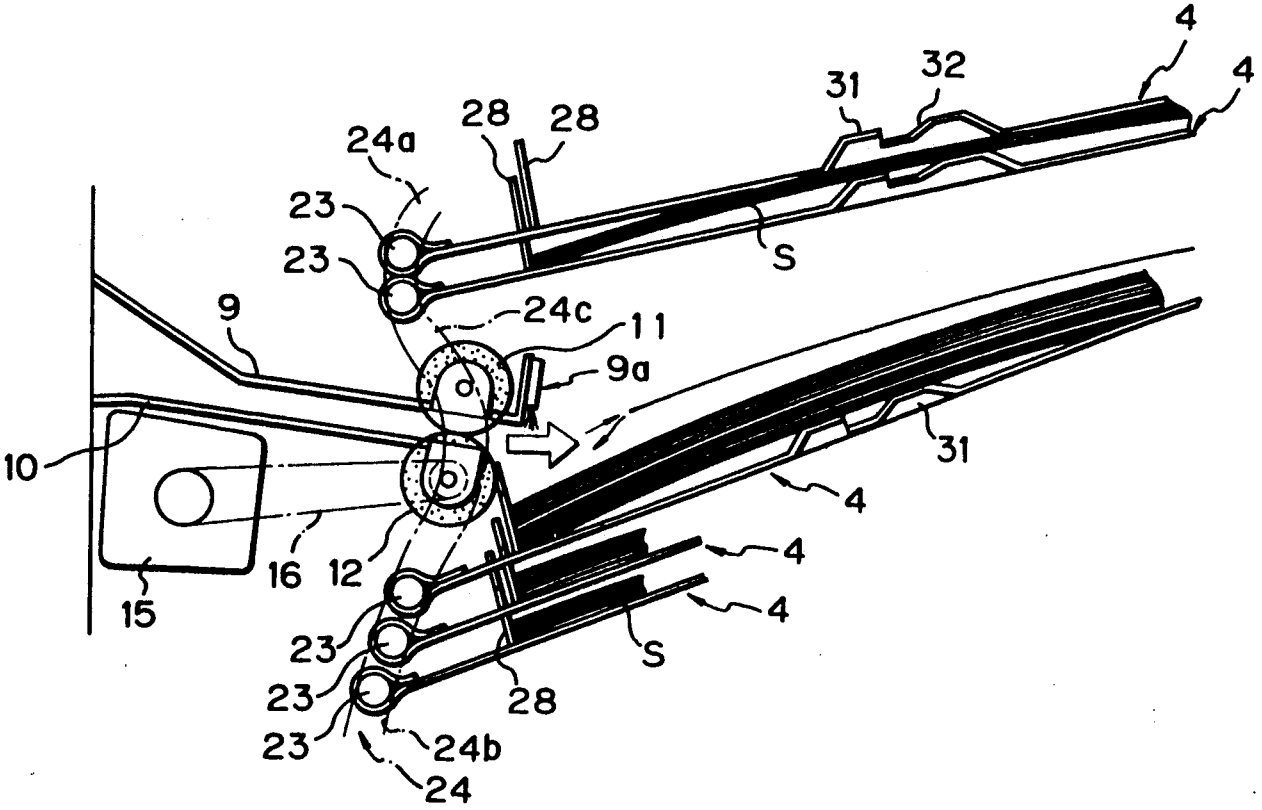
FIG. 4 is a fragmentary enlarged view representative of the condition shown in FIG. 2.
Figure 5:
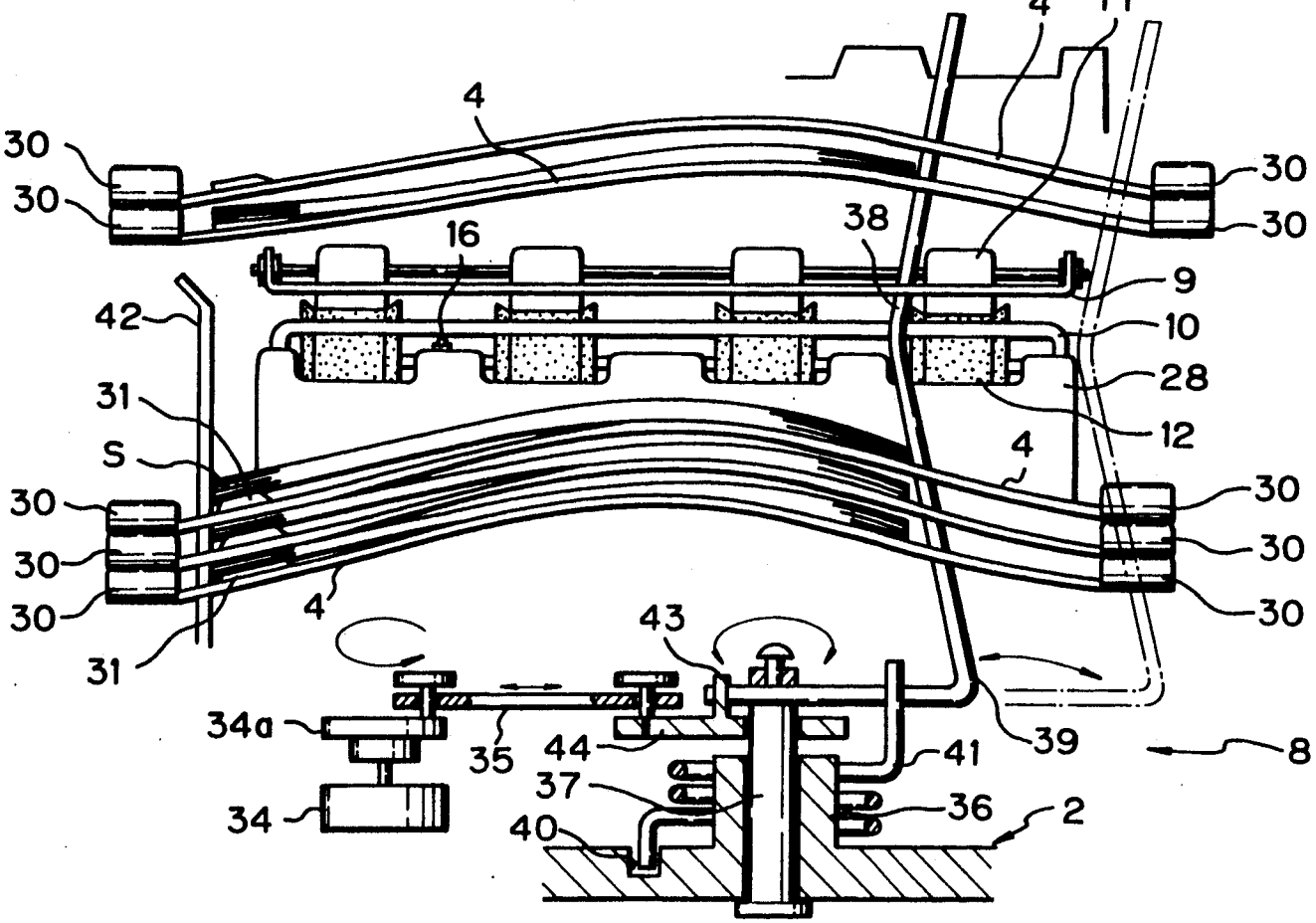
FIG. 5 is a view as seen in a direction indicated by an arrow in FIG. 4.
Figure 10:
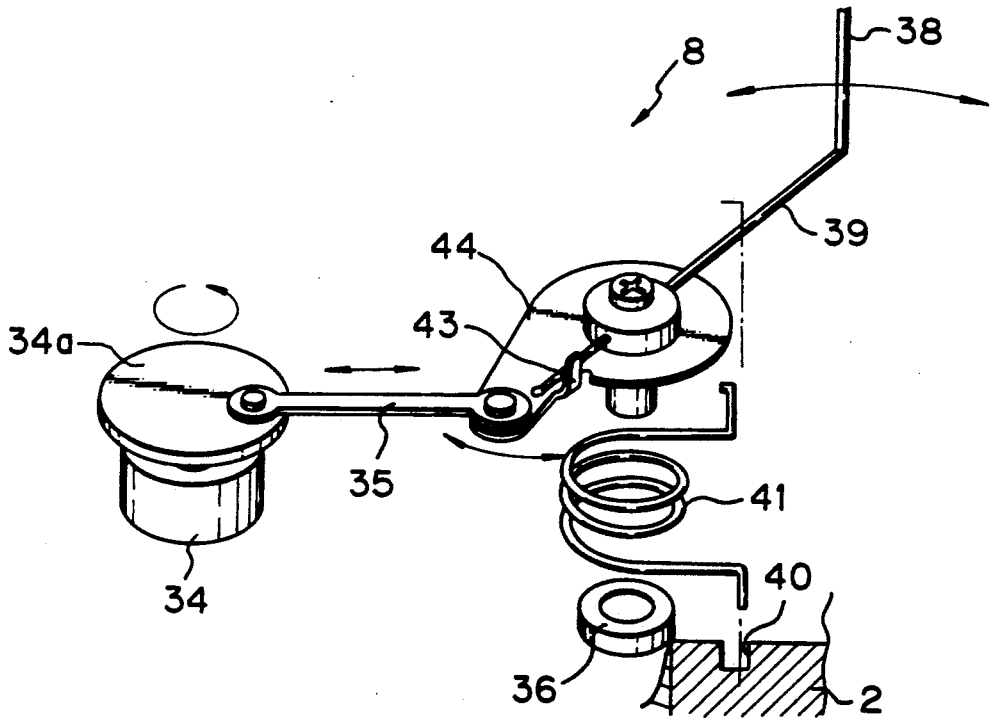
FIG. 10 is an exploded perspective view of a jogger.

As shown in FIG. 8, the jogger FIGS. 5 and 10 has a motor 34, a disk 34a mounted on the output shaft of the motor 34, a link 35, a shaft 37 rotatably supported by a bearing 36 which is mounted on the bottom frame 2, a jogger arm 39 having a projectin 38 bent in a positioning direction and located substantially at the center thereof, a coiled torsion spring 41 retained at one end by the jogger arm 39 and at the other end by a recess 40 formed in the bottom frame 2 for constantly biasing th ejoger arm 39 in the positioning direction, and a rotatable plate 44 movably mounted on the shaft 37 and retains one end of the link 35. An abutment 43 protrudes from the rotatable plate 44 for abutting against and urging the jogger arm 39 in the direction opposite to the jogging direction. As shown in FIGS. 1 through 3, the jogger arm 39 extends vertically at the side of the stack of bins 4 with the projection 38 thereof positioned in the space 25 between the upper and lower bin groups. In operation, the projection 38 of the jogger arm 39 abuts against only the edge of a sheet S which has just been driven out to the uppermost bin 4 of the lower bin group, thereby urging this sheet S against a reference surface 42.

Figure 14:
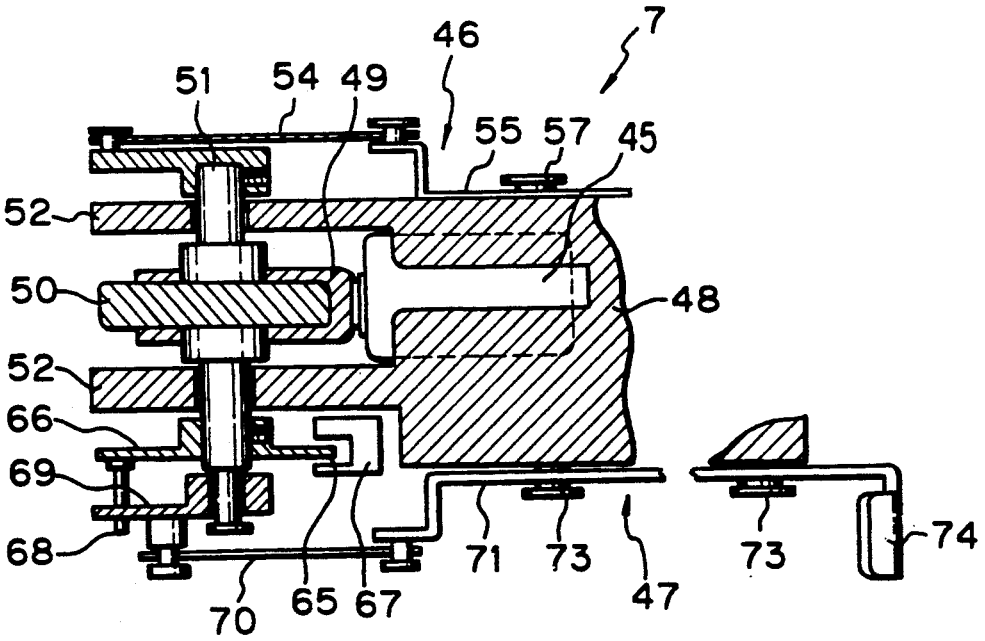
FIG. 14 is a partly omitted cross-section of the sheet stack moving means.

The sheet stack moving device 7 has a motor 45 (see FIG. 11B), a pull-out mechanism 46 ( see FIGS. 11A through 11E) driven by the motor 45, and a push-back mechanism 47. As shown in FIGS. 11B and 14, the motor 45 is received in a cavity formed in a support frame 48. A screwed gear 49 is mounted on the output shaft of the motor 45. A screwed gear 50 is mounted on a transmission shaft 51 and held in mesh with the screwed gear 49. The transmission shaft 51 extends throughout and are journalled to two support pieces 52 which form part of the support frame 48. The shaft 51 drives the pull-out mechanism 46 at one of the opposite ends extending out from the support pieces 52 and drives the push-back mechanism 47 at the other end.

Figure 11A:
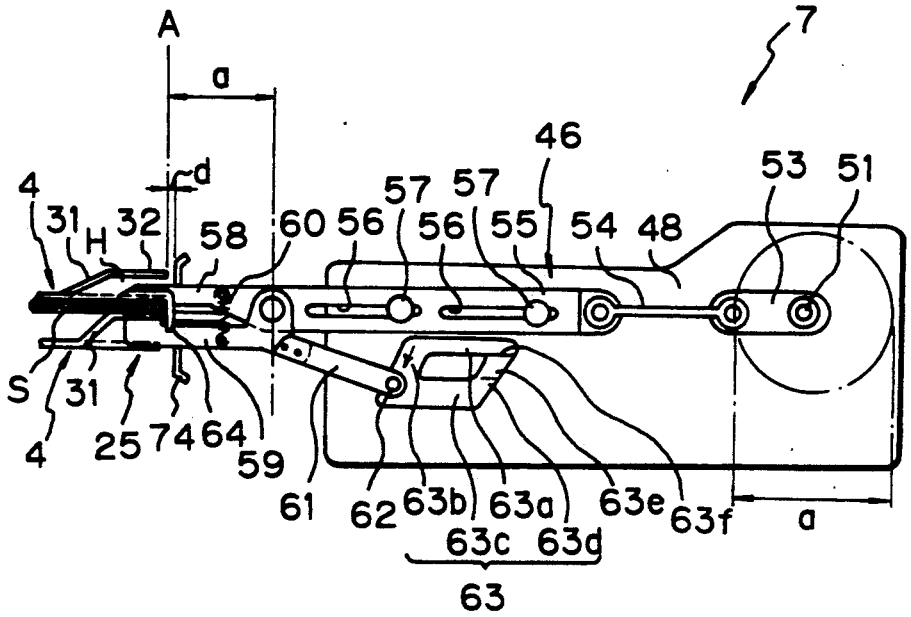
FIGS. 11A through 11E are views each showing a sheet stack moving devcie including in the embodiment in a particular operating condition.
Figure 11B:
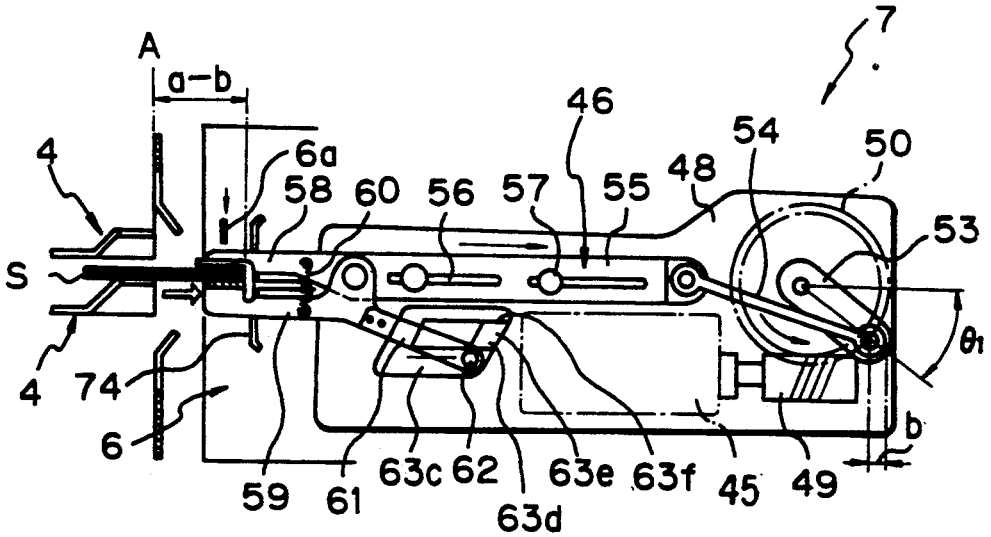

As shown in FIG. 11A, a crank arm 53 is affixed to one end of the transmission shaft 51 at one end thereof and connected to a slider 55 by a link 54 at the other end thereof. The crank arm 53 and link 54 cooperate to transform a rotary motion to a linear motion. Guide slots 56 are formed through the slider 55, and each receives a guide pin 57 studded on the support frame 48. The other end of the slider 55 constitutes an upper gripper part 58. A lower gripper part 59 is rotatably mounted on the slider 55 to be movable toward the upper gripper part 58 to grip a stack of sheets S. A tension spring 60 is anchored at opposite ends thereof to the upper and lower gripper parts 58 and 59, constantly biasing the lower part 59 toward the counterpart 58. A leaf spring 61 is affixed to the lower gripper part 59, while a cam follower in the form of a pin 62 is studded on the free end of the leaf spring 61. The cam follower or pin 62 is received in a cam groove 63 formed in the side surface of the support frame 48 and pressed against the bottom of the cam groove 63 by the leaf spring 61. The cam follower 62 is slidable along the cam groove 63 to move or open the lower gripper part 59 against the action of the tension spring 60.

Figure 12:
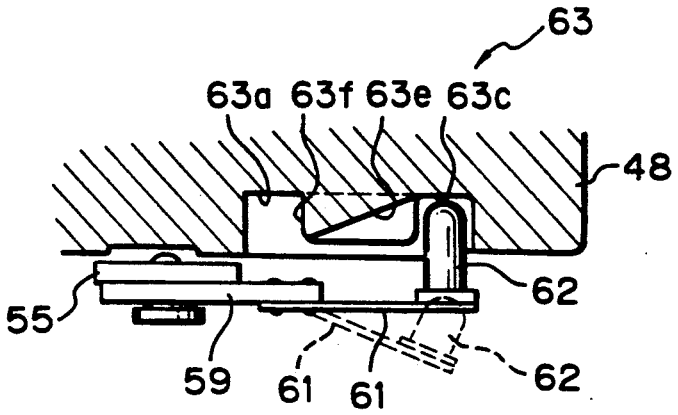
FIG. 12 is a fragmentary section showing a specific configuration of a cam groove.

The cam groove 63 has a generally parallelogrammatic configuration defined by an upper groove 63*a*, a left groove 63*b*, a lower groove 63*c*, and a right groove 63*d*. As shown in FIG. 12, the right groove 63*d* is provided with a slant 63*e* and a shoulder 63*f* for preventing the cam follower 62 from reversing. In the illustrative embodiment, the cam follower 62 slides counterclockwise along the groove 63. The cam follower 62 moves the lower gripper part 59 away from the upper gripper part 58 to the most widely open position when located in the upper groove 63*a*. When located in the lower groove 63*c*, the cam follower 62 causes the lower gripper part 59 to grip the sheets S in cooperation with the counterpart 58. The lower groove 63*c* has a greater width than the other three grooves to allow the gripper parts 58 and 59 to hold sheets S adequately with no regard to the thickness under the action of the tension spring 60. The reference numeral 74 designates a positioning piece which abuts against and positions the edge of a sheet stack to be gripped.

Figure 13:
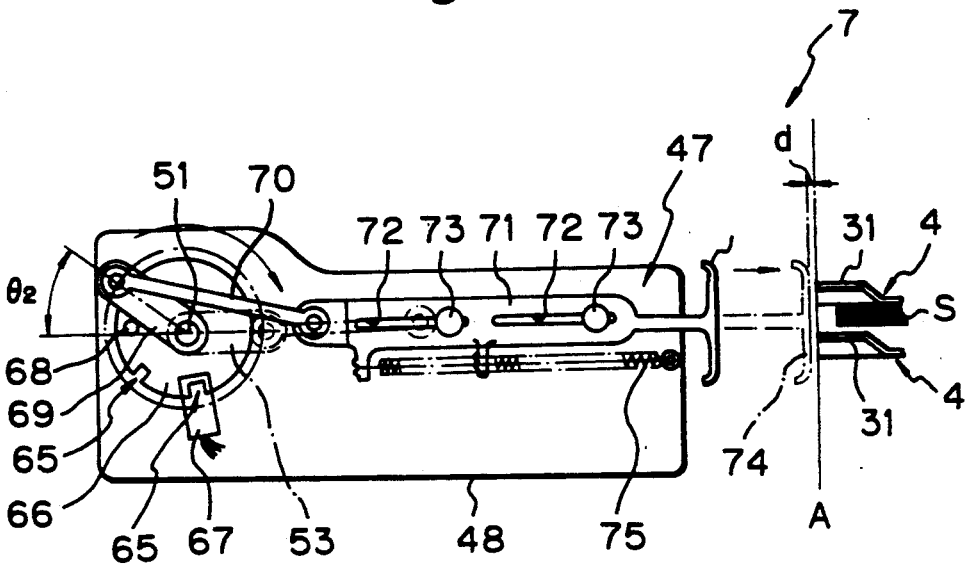
FIG. 13 is a rear view of the sheet stack moving device shown in FIG. 11D.

As shown in FIGS. 13 and 14, the push-back mechanism 47 has a drive disk 66 which is affixed to the other end of the transmission shaft 51. The drive disk 66 has notches 65 to be sensed by a sensor 67. A push pin 68 is studded on the drive disk 66 and rotates a crank arm 69 which is movably coupled over the transmission shaft 51. The free end of the crank arm 69 is connected to a slider 71 by a link 70 to transform the rotary motion of the drive disk 66 to the linear motion of the slider 71. Guide slots 72 are formed through the slider 71, and each receives therein a guide pin 73 studded on the support frame 48. The slider 71 has the other end thereof a thrust piece 74 which is configured as to force the sheets S pulled out from the bin 4 by the pull-out mechanism 46 into the bin 4 due to the sliding movement of the slider 71. A tension spring 75 is preloaded between the slider 71 and the support frame 48 to constantly bias the thrust piece 74 in the thrusting direction. Specifically, the tension spring 13 biases the slider 71 to the right as viewed in FIG. 13. The drive disk 66 and, therefore, the push pin 68 studded thereon is rotated clockwise as viewed in FIG. 13. As the push pin 68 moves the crank arm 69 from a position P1 to a position P2 over an angle $\theta_2$, the friction balance is lost with the result that the crank arm 69 is rapidly rotated away from the push pin 68 by the force of the tension spring 75 to in turn cause the slider 71 to move to the left fast.

The finisher having the above construction will be operated as follows.

FIG. 1 shows a particular condition in which all the bins 4 are received in the upper linear portion 24*a* of the upper guide slot 24 above the Geneva wheel 21. In this condition, the pin 23 of the lowermost bin 4 rests on the periphery of the Geneva wheel 21 due to gravity while the spacer 30 of the bin 4 rests on the top 33*b* of the lower frame 2. The shaft 26 is pressed against the periphery of the Geneva wheel 21 from below under the action of the coil spring 27. The diameter of the pin 23 and the height of the spacer 30 are selected such that the bins 4 stacked one upon another are positioned parallel to each other. The pin 23 of the uppermost bin 4 is held in contact with the upper limit switch 13.

As the motor 19 is driven to rotate the Geneva wheel 21 clockwise until the recess 22 thereof reaches the guide slot 24, the pin 23 of the lowermost bin 4 enters the recess 22 and then moved downward along the bent portion 24*c* of the slot 24. When the pin 23 of the bin 4 of interest reaches the lower linear portion 24*b* of the guide slot 24, it moves out of the recess 22 due to the inclination of the lower linear portion 24*b* and then abuts against the shaft 26 while being forced downward by the recess 22. When the pin 23 is so moved downward, the spacer 30 of the bin 4 slides from the top 33*b* to the inclined surface 33*a*. On the other hand, the pin 23 entered the lower linear portion 24*b* is held in abutment against the periphery of the Geneva wheel 21 from below by the shaft 26 which is constantly biased upward by the coil spring 27. Consequently, this bin 4 is supported in a predetermined position. In the same manner, the other bins 4 are sequentially transferred from the upper linear portion 24*a* to the lower linear portion 24*b* one at a time. FIG. 2 shows another particular condition in which five bins 4 have been received in the lower linear portion 24*b*.

As shown in FIG. 2, the upper bin group and the lower bin group each is inclined by a different angle, so that the space 25 which sequentially broadens toward the Geneva wheel 21, i.e., the upper and lower rollers 11 and 12 is defined. The sheet stack moving device 7 is located to face the space 25. The spacers 30 of the bins 4 belonging to the lower bin group have been shifted from the top 33*b* to the inclined surface 33*a* of the guide piece 33, as stated earlier. As the pin 23 of each bin 4 is moved in the lower straight portion 24*b*, the spacer 30 of the bin 4 resting on the inclined surface 33*a* is moved by the same displacement as the pin 24.

The jogger 8 neatly positions a stack of sheets S so that the stack may be successfully bound by the stapler 6. The jogger 8 moves every time a sheet S is driven out onto the uppermost bin 4 of the lower bin group. Specifically, as shown in FIGS. 3 and 5, the jogger arm 39 is movable in a reciprocating motion between a position indicated by a phantom line and a position indicated by a solid line. As the motor 34 is energized, the disk 34*a* is rotated as indicated by an arrow to cause the rotatable plate 44 to rotate a predetermined angle via the link 35. The rotatable range of the plate 44 is selected to be greater than that of the jogger arm 39, i.e., it overlaps the minimum sheet size to be dealt with. Hence, the jogger arm 39 sucessfully urges a paper sheet S against the reference surface 42 with no regard to the sheet size, under the action of the coiled torsion spring 41. At this instant, the projection 38 of the jogger arm 39 is located in the space 25 and abuts against only the sheet S which has just been distributed to the uppermost bin 4 of the lower bin group. The force of the torsion spring 41 is just sufficient to urge a single sheet S of maximum size which can be accommodated in the bin 4. Stated another way, the torsion spring 41 cannot deform a sheet S overcoming the elasticity of the sheet S. This allows the jogger arm 39 to move over a substantial distance and, as soon as it positions the sheet S, stop naturally without deforming the sheet S.

Figure 8A:
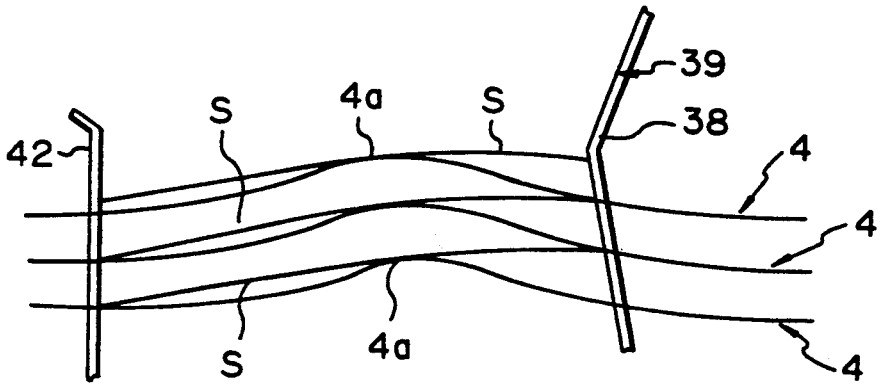
FIG. 8A and 8B each shows a particular configuration of the bin.
Figure 8B:
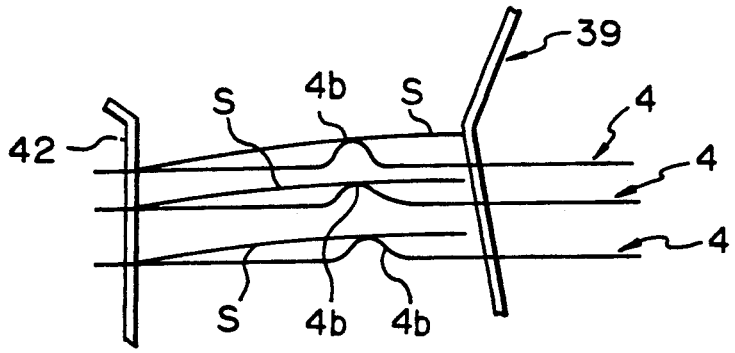

FIGS. 8A and 8B each shows a particular configuration of the bin 4 which allows the sheets S stacked thereon to be biased toward the reference surface 42. The bin 4 shown in FIG. 8A is gently convex upward and has a pack 4*a* at substantially the intermediate between opposite ends thereof with respect to the direction in which the paper sheet S advances. The bin 4 shown in FIG. 8B has a lug 4*b* at substantially the intermediate between opposite ends thereof. The peak 4*a* or the lug 4*b* is remoter from the reference surface 42 than the center of the sheet S, so that the sheet S on the bin 4 is biased toward the reference surface 42 by gravity. This is successful in causing the stacked sheets to become stable in abutment against the reference surface 42 and in reducing required positioning force of the jogger 8. The vibration ascribable to the up-down movement of the bin 4 is rather desirable in promoting the positioning of the sheets S since it will dislocate the sheets S toward the reference surface 42. Moreover, the sheets stacked on the bin 4 assume a higher level at the opposite side to the reference surface 42 due to the peak 4*a* or the lug 4*b*. As a result, when the bins 4 are positioned close to each other as in the upper or lower bin group, the sheets S are lightly nipped by the bin 4 immediately above the bin 4 which is loaded with the sheets S and the elasticity particular to the sheets S. The resultant adequate degree of friction prevents the sheet stack once positioned from being disolocated.

Figure 9:
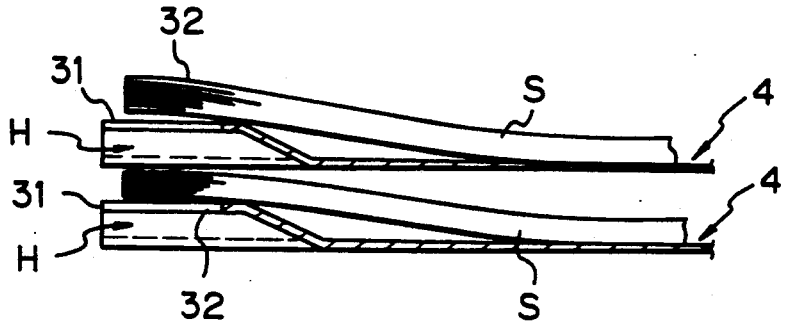
FIG. 9 is view representative of a position of sheets resting on a shaped portion included in the bin.

FIG. 9 shows the bins 4 each being loaded with a stack of sheets S. As shown, each bin 4 has a protuberance 31 located beneath the end portion of sheet stack. Hence, gaps H are defined above and below the end portion of each sheet stack. The upper gripper part 58 stated previously is capable of entering the gap H to grip the sheet stack, as will be described.

How a sheet stack is moved will be described with reference to FIGS. 11A through 11D. In FIGS. 11A through 11D and FIG. 13, there are shown the end portion A of a sheet stack, the stroke a of the slider 55, the position b where the lower gripper part 59 is opened, the rotation angle $\theta_1$ of the crank arm 53 corresponding to the position b, the position c where the lower gripper part 59 begins to close, the distance d between the thrust piece 74 in a protected position and the end portion A of the sheet stack, and the rotation angle $\theta_2$ which destroys the friction balance.

In the condition shown in FIG. 11A, the slider 55 is protruded toward the bin 4, and the cam follower or pin 62 is located in the lower groove 63*c* of the cam groove 63. Since the lower groove 63*c* is not engaged with the cam follower 62, the lower gripper part 59 is urged toward the counterpart 58 by the tension spring 60 to thereby grip a sheet stack therebetween. It is the sheet stack accommodated in the lowermost bin 4 of the upper bin group that is gripped and stapled. The upper grip part 58 is inserted in the gap H defined by the protuberance 31 of the bin 4 overlying the lowermost bin 4, while the counterpart 59 is disposed in the space 25 below the lowermost bin 4 and pressed against the bottom of the sheet stack through the notch 32.

As the motor 45, FIG. 11B, is driven to rotate the crank arm 53 counterclockwise, the slider 55 is slid to the right via the link 54. Then, the sheet stack retained by the upper and lower gripper parts 58 and 59 is pulled out from the bin 4 and brought to the stapler 6, as shown in FIG. 11B. At this instant, the cam follower 62 has arrived at the right groove 63*d* of the cam groove 63 and slides upward along the groove 63*d*. As a result, the lower gripper part 59 is moved away from the counter part 58 against the action of tension spring 60, thereby releasing the sheet stack. At the same time or just before such a movement of the lower gripper part 59, the stapler 6 is operated to bind the sheet stack by a staple 6*a* in a predetermined manner.

Figure 11C:
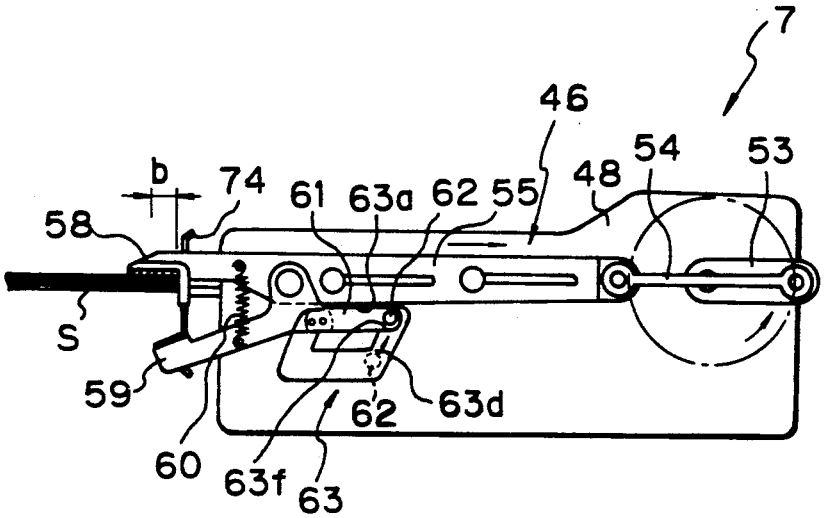

As shown in FIG. 11C, the crank arm 53 is further rotated to shift the slider 55 to the right by the distance b. In this condition, the slider 55 reaches the right end of the stroke a thereof. The cam follower 62 sliding upward along the right groove 63*d* from the position shown in FIG. 11B is transferred to the upper groove 63*a*. The right groove 63*d* is provided with the sant 63*e* and shoulder 63*f*, as stated earlier with reference to FIG. 2. Hence, as shown in FIG. 11C, the cam follower 62 reached the upper groove 63*a* is prevented from returning to the right groove 63*d* in the event of the next movement.

Figure 11D:
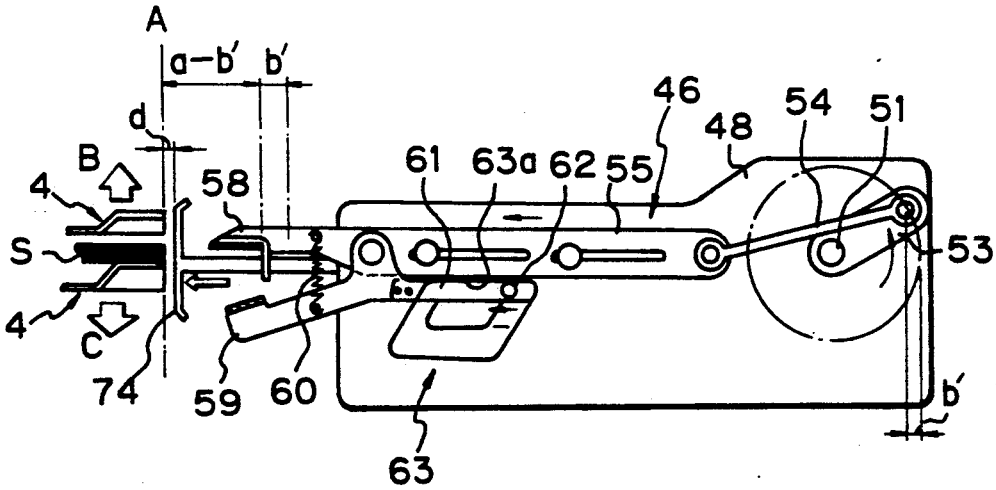

The crank arm 53 is further rotated counterclockwise from the position shown in FIG. 11C to the position shown in FIG. 11D. Specifically, the crank arm 53 in rotation causes the slider 55 to slide to the left by the distance b via the link 54. The cam follower 62 moving along the upper groove 63*a* moves the lower gripper part 59 to the most widely open position. In the condition shown in FIG. 11D, the push-back mechanism 47 begins to operate.

While the pull-out mechanism 46 is operated as stated above, the push-back mechanism 47 assumes the position shown in FIG. 13. In FIG. 13, as the drive disk 66 mounted on one end of the transmission shaft 51 is rotated clockwise (or clockwise as viewed in FIG. 11A), the push pin 68 rotates the crank arm 69 clockwise against the action of the tension spring 75 and thereby moves the slider 71 to the left. As shown in FIG. 13, when the crank arm 69 is further rotated after the slider 71 has passed the left end of its stroke, the friction balance is lost. As a result, the slider 71 is thrusted out by the force of the tension spring 75 while, at the same time, the crank arm 69 is rotated fast away from the push pin 68 by the crank arm 69. Consequently, the thrust piece 74 of the slider 71 pushes back the stapled sheet stack into the bin 4. It is noteworthy that the thrust piece 74 plays the role of an abutment for positioning a paper stack and, therefore, eliminates the need for a conventional openable abutment associated with each bin and a mechanism for opening the abutment. This is successful in speeding up the movements for pulling out a sheet stack from the bin 4. The notches 65 of the drive disk 66 are so positioned as to match the angles $\theta_1$ and $\theta_2$, respectively. While the sensor 67 senses the notches 65 and sends the resulted signals to the controller 17, the controller 17 controls the rotation of the motor 45 such that the crank arm 69 stops at the positions corresponding to the angles $\theta_1$ and $\theta_2$.

In the position shown in FIG. 11D, the motor 45 is held in a halt, and the bins 4 are shifted one step in a direction B or C until the next bin 4 reaches the staple position (the bottom of the upper bin group in the embodiment). Thereupon, the motor 45 is energized to rotate the transmission shaft 51 with the result that the slider 55 is moved to the left. So long as the cam follower 62 moves along the upper groove 63 of the cam groove 63, the lower gripper part 59 is held in the most widely open position. In this condition, the upper gripper part 58 is inserted in the gap H above the sheet stack, while the counterpart 59 is inserted in the space 25 below the sheet stack. Since the sheet stack is held between the protuberance 31 of the bin 4 supporting the sheet stack and the underside of the bin 4 lying above the bin 4 of interest, the gripper parts 58 and 59 surely grip the sheet stack even when the sheets S of the stack are curled or otherwise deformed. The motion of the lower gripper part 59 can be freely designed since it is disposed in the wide space 25 between the bins 4.

Figure 11E:
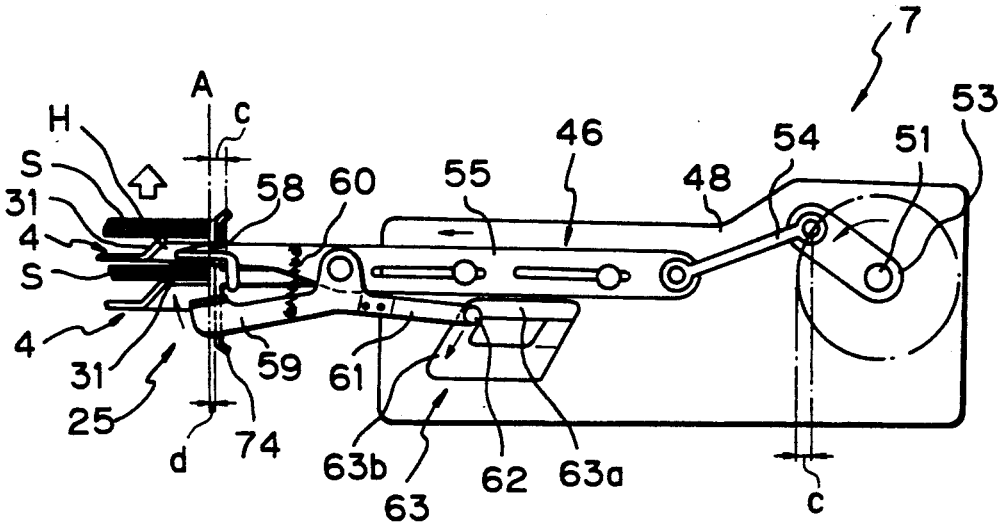

In the position shown in FIG. 11E, the cam follower 62 moves from the upper groove **63*a* to the left groove 63*b* and, therefore, slides downward along the left groove 63*b*. Then, the lower gripper part 59 is again moved toward the counterpart 58 under the action of the tension spring 60, until it regains the position shown in FIG. 11A**.

The operation described above is repeated until all the sheet stacks accommodated in particular bins 4 have been stapled.

In the illustrative embodiment since the pull-out mechanism 46 draws the sheet stack out of the bin 4, the spacers 30 located at the leading end of the bin 4 are positioned outside of the position of the sheet stack having been drawn out.

The rear fence 28 of the bin 4 located at the trailing end of the bin 4 is located downstream of the outside diameter of the Geneva wheel 21 with respect to the direction in which the sheet S advances. This facilitates the arrangement of the stapler 6.

The upper and lower rollers 11 and 12 for discharging a sheet S are journalled to the upper and lower guide plates 9 and 10, respectively. Hence, it is not necessary to provide independent bearing structures at both sides of the rollers 11 and 12, allowing the width W over which a sheet S travels to be set at any desired position.

The jogger arm 39 of the jogger 8 abuts against only a single sheet S which has just been driven out onto the bin 4 and can do so even when the bins 4 are shifted. The positioning arm 39 can surely urge a sheet S even if it is somewhat distorted or deformed.

The lowermost bin 4 is biased upward by the shaft 26 and coil spring 27 which constitute raising means and, therefore, can be moved upward by the bin shifting device 5. After the lowermost bin 4 has been moved to the upper portion of the device 5 (away from the shaft 26), no biasing forces act on the lowermost bin 4. Therefore, the lowermost bin 4 can be moved upward in the same manner as the other bins 4 overlying it, whereby all the sheets stacked on the bins 4 can be stapled.

The lower gripper part 59 is moved toward and away from the upper gripper part 58 by the cam groove 63. The cam groove 63, therefore, does not have to move in a linear motion together with the upper and lower gripper parts 58 and 59, promoting a compact arrangement and rapid movements of the gripper parts 58 and 59 as well as other movable members. The lower gripper part 59 which is moved by the cam groove 63 grips a sheet stack surely and simply.

The bins 4 belonging to the upper bin group and the bins 4 belonging to the lower bin group are supported by different portions, i.e., the top **33*b* and the inclined leg 33*a* of the support piece 33. The support portions each matches the particular position of the associated bin group. Specifically, at a given location, all the bins 4 are supported in an identical position at opposite ends thereof. Hence, it is possible to use the position where the lowermost bin 4 of the upper bin group is located as a staple position and fix the stapler 6 and sheet stack moving device 4 in place at such a staple position. Stapling, therefore, is readily practicable even with an apparatus of the type sequentially turning over the bins 4** by a simple arrangement.

The lower or movable gripper part 59 is disposed in the space 25 while the upper or stationary gripper part 58 is inserted in the gap between nearly bins 4. This makes it needless to provide a wide space on opposite sides of a bin 4, i.e., allows a sheet stack to be moved only if a space is available on one side (below) a bin 4, reducing the overall height of the finisher.

The protuberance 31 of each bin 4 and the underside of the overlying bin 4 cooperate to restrain the sheet stack to some degree. The sheet stack, therefore, can enter the opening between the gripper parts 58 and 59 smoothly even if it is curled or otherwise deformed.

Various modifications will become possible for those skilled in the art after receiving the teachings of the present disclosure without departing from the scope thereof. For example, the raising means implemented by the shaft 26 and coil spring 27 may be constituted by any other suitable members such as a spiral guide.

What is claimed is:

1. A finisher for use with an image forming apparatus for distributing a plurality of recorded sheets sequentially coming out of said apparatus through an outlet to a plurality of bins to stack said recorded sheets on said pularlity of bins, comprising:

bin moving means for sequentially moving said plurality of bins to a predetermined position where said plurality of bins face said outlet;

a bin inlet defined between, among said plurality of bins, an upper bin and a lower bin having been moved to said predetermined position for receiving the recorded sheets one at a time;

stapling means for stapling the recorded sheets stacked on each of said plurality of bins at a staple position; and sheet stack moving means for pulling out a stack of the recorded sheets from each of said plurality of bins to said staple position, causing said stapling means to staple said stack, and then returning said stack to said bin;

wherein said sheet stack moving means comprises:

a first gripping member movable toward and away from each of said bins in a linear motion;

a second gripping member rotatably mounted on said first gripping member;

a cam follower in the form of a pin studded on one end of said second gripping member; and a cam groove along which said cam follower is movable due to said linear motion, whereby said second gripping member performs a sequence of movements for gripping the stack, moving said stack, and releasing said stack.

2. A finisher as claimed in claim 1, wherein said bin moving means comprises means for supporting only one end of said bins while said bin moving means sequentially moves said plurality of bins to said predetemined position.

3. A finisher as claimed in claim 2, wherein said bin moving means comprises a support member for guiding and supporting the other end of each of said plurality of bins.

4. A finisher as claimed in claim 3, wherein said support member comprises a first support portion for supporting said upper bin defining said inlet in cooperation with said lower bin, and a second support portion for supporting said lower bin.

5. A finisher as claimed in claim 1, wherein said sheet stack moving means comprises pulling means for pulling out the stack from said bin to said staple position, and returning means for pushing back said stack into said bin.

6. A finisher as claimed in claim 1, wherein said bins each comprises an upwardly bent protuberance in a portion thereof where said first gripping member enters for gripping the stack, said protuberance defining a gap between the underside thereof and said stack to be gripped by said first gripping member.

7. A finisher as claimed in claim 1, wherein each one of said bins is convex at an intermediate portion between opposite ends thereof of said bins with respect to an intended direction of movement of the recorded sheets into said bin, whereby said recorded sheets stacked on said bin are automatically biased toward a reference position for stapling.

8. A finisher for use with an image forming apparatus for distributing a plurality of recorded sheets sequentially coming out of said apparatus through an outlet to a plurality of bins to stack said recorded sheets on said plurality of bins, comprising:

bin moving means for sequentially moving said plurality of bins to a predetermined position where said plurality of bins face said outlet;

a bin inlet defined between, among said plurality of bins, an upper bin and a lower bin having been moved to said predetermined position for receiving the recorded sheets one at a time;

stapling means for stapling the recorded sheets stacked on each of said plurality of bins at a staple position; and sheet stack moving means comprising means for gripping and pulling out a stack of the recorded sheets from each of said plurality of bins to said staple position, causing said stapling means to staple said stack, and pushing means for returning said stack to said bin;

wherein each one of said bins comprises an upwardly bent protuberance in a portion thereof where said means for gripping and pulling enters for gripping the stack, said protuberance defining a gap between the underside thereof and said stack to be gripped by said means for gripping and pulling.

9. A finisher for use with an image forming apparatus for distributing a plurality of recorded sheets sequentially coming out of said apparatus through an outlet to a plurality of bins to stack said recorded sheets on said plurality of bins, comprising:

bin moving means for sequentially moving said plurality of bins to a predetermined position where said plurality of bins face said outlet;

a bin inlet defined between, among said plurality of bins, an upper bin and a lower bin having been moved to said predetermined position for receiving the recorded sheets one at a time;

stapling means for stapling the recorded sheets stacked on each of said plurality of bins at a staple position; and sheet stack moving means for pulling out a stack of the recorded sheets from each of said plurality of bins to said staple position, causing said stapling means to staple said stack, and then returning said stack to said bin;

wherein said bin moving means comprises a support member for guiding and supporting the other end of each of said plurality of bins, and said support member comprises a first support means for supporting said upper bin defining said inlet in cooperation with said lower bin, and a second support means for supporting said lower bin.

* * * * *